United States Patent [19]

Stants et al.

[11] Patent Number: 4,607,588

[45] Date of Patent: Aug. 26, 1986

[54] PARTS COATING APPARATUS AND METHOD

[76] Inventors: Richard O. Stants, 1508 Pontiac Dr.; Kerry J. Olds, 2719 N. Rockford Ct., both of Kokomo, Ind. 46902

[21] Appl. No.: 596,679

[22] Filed: Apr. 4, 1984

[51] Int. Cl.[4] ..... B05C 13/02

[52] U.S. Cl. ..... 118/52; 118/56; 118/303; 118/320; 118/697

[58] Field of Search ..... 118/52, 303, 320, 697, 118/56

[56] References Cited

U.S. PATENT DOCUMENTS

| | | | |
|---|---|---|---|
| 1,525,255 | 3/1925 | Starks | 118/52 |
| 2,165,936 | 11/1939 | Miller | 118/52 |
| 3,106,492 | 10/1963 | MacDonald et al. | 118/303 |
| 3,845,740 | 11/1974 | Ferrara | 118/52 |
| 4,196,231 | 4/1980 | Hubers | 118/52 |

*Primary Examiner*—Michael R. Lusignan
*Assistant Examiner*—Janyce A. Bell
*Attorney, Agent, or Firm*—David A. Lundy; Robert L. Walker

[57] ABSTRACT

A parts coating apparatus and method for applying coating material to parts. The apparatus comprising a housing, a motor supported by the housing, a head driven by the motor and rotatably mounted to the housing. A basket, to contain the parts, is detachably coupled to the head. The basket is generally perforate to the coating material. A coating compartment separably encloses the basket. The coating compartment is generally imperforate to the coating material. A spray tube, to spray the coating material communicates with the coating compartment. A coating material system supplies coating material to the spray tube. A control system selectively actuates the motor and the coating material system.

37 Claims, 8 Drawing Figures

PARTS COATING APPARATUS AND METHOD

BACKGROUND OF THE INVENTION

In prior art automatic coating and painting systems, small parts and components are placed in a basket and the basket is coupled to a machine which dips the basket one or more times in a reservoir of paint or other coating material. The basket is then withdrawn from the reservoir and spun rapidly to remove any excess coating material from the parts.

This prior art coating process is effective, but has several severe limitations. The reservoir must contain a large amount of coating material and the coating material in the reservoir can become contaminated after a coating cycle from contaminants on the parts being coated. This degrades the quality of subsequent coating runs unless the coating material is changed. In practice, the coating material in the reservoir is replaced frequently to ensure against contamination and resultant poor quality parts coating. This results in usage of large amounts of coating material, frequent machine down time and a relatively large coating cost per part produced.

Another problem with prior art coating machines is that coatings are applied as a relatively thick single layer. If fast drying coating materials are used, parts in contact with each other adhere together as the coating partially dries, resulting in imperfections on finished parts. Prior art coating machines thus cannot readily use coating materials which could dry appreciably before parts were removed from the coating machine and spread on drying tables.

Additional problems of prior art coating machines are difficult loading, unloading and cleaning procedures.

It is therefore highly desirable to provide an improved parts coating apparatus and method for the high volume coating of small parts. It is also highly desirable to provide an improved parts coating apparatus and method for spray coating parts using both conventional and fast drying coating materials. It is also highly desirable to provide an improved parts coating apparatus wherein the excess coating material can be automatically recycled through a filtering system back to the reservoir containing the coating material.

It is yet also highly desirable to provide an improved parts coating apparatus in which the parts can be coated under an inert gas atmosphere.

It is yet also highly desirable to provide an improved parts coating apparatus which centrifugally removes excess coating material and which has an improved locating mechanism which stops the spinnning basket of parts being coated in a specific position from which the basket can be easily withdrawn from the apparatus.

It is still further highly desirable to provide an improved parts coating apparatus which has all of the above features.

Finally it is highly desirable to provide a method for coating parts by loading parts into a basket, placing the basket in a coating compartment, spraying the parts with a coating material while the basket is in the coating compartment, agitating the parts in the basket while the basket is in the coating compartment, removing the basket from the coating compartment, and unloading the parts from the basket and an apparatus for performing the method.

SUMMARY OF THE INVENTION

Accordingly, it is an object of this invention to provide an improved parts coating apparatus and method for the high volume coating of small parts.

It is another object of this invention to provide an improved parts coating apparatus and method for spray coating parts using both conventional and fast drying coating materials.

It is another object of this invention to provide an improved parts coating apparatus wherein the excess coating material can be automatically recycled through a filtering system back to a reservoir containing the coating material.

It is another object of this invention to provide an improved parts coating apparatus in which the parts can be coated under an inert gas atmosphere.

It is another object of this invention to provide an improved parts coating apparatus which centrifugally removes excess coating material and which has an improved locating mechanism which stops the spinning basket of parts in a specific position from which the basket can be easily withdrawn from the machine.

In the broader aspects of the invention there is provided a parts coating apparatus and method for applying coating material to parts. The apparatus comprising a housing, a motor supported by the housing, a head driven by the motor and rotatably mounted to the housing. A basket, generally perforate to the coating material, for containing the parts, is detachably coupled to the head. A coating compartment generally imperforate to the coating material, separably encloses the basket. A spray tube, to spray the coating material, communicates with the coating compartment. A coating material system supplies coating material to the spray tube, and a control system selectively actuates the motor and the coating material system.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings, wherein.

DESCRIPTION OF A SPECIFIC EMBODIMENT

Figure 1:
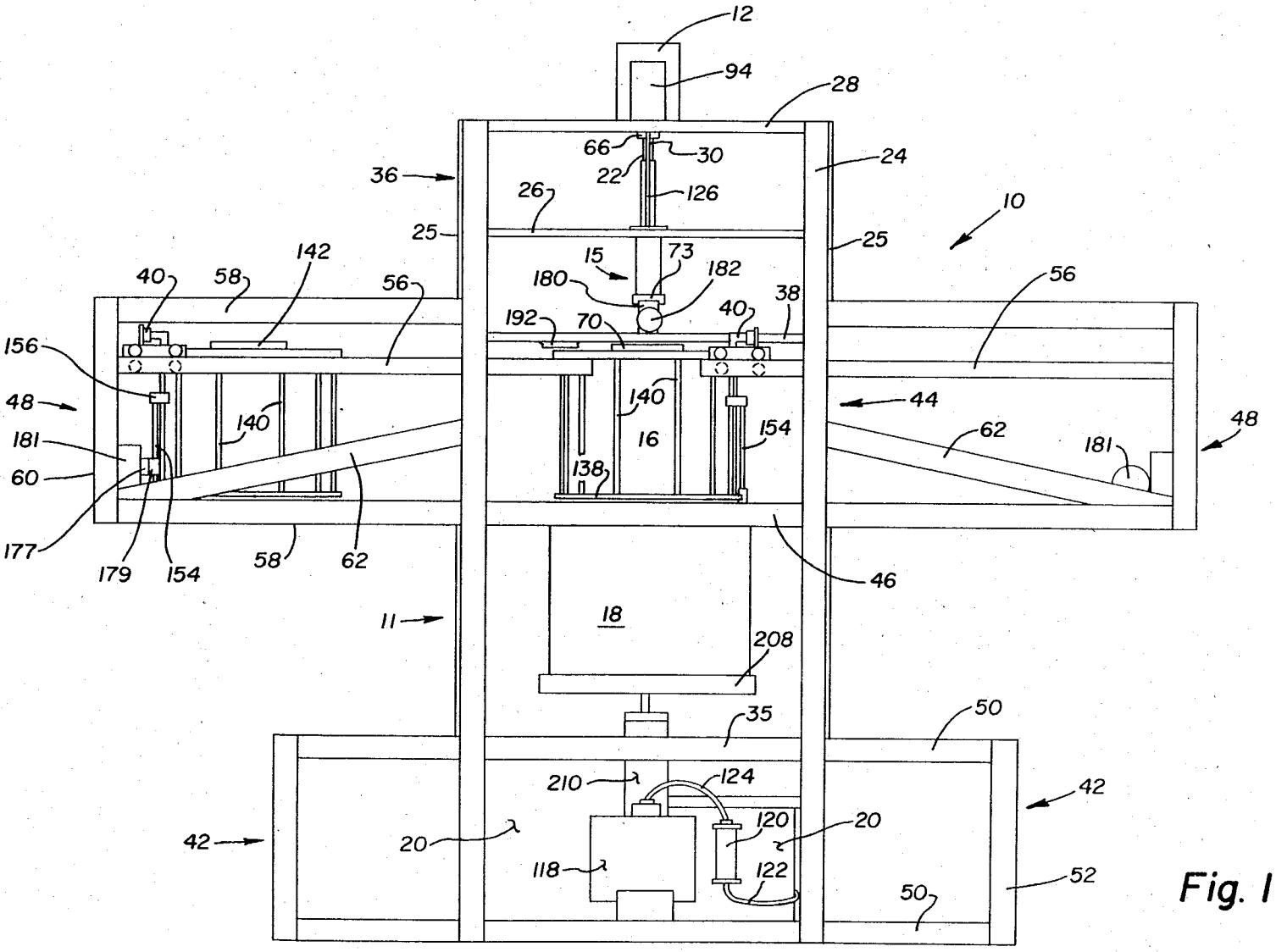
FIG. 1 is a rear plan view of the apparatus of the invention with the coating chamber in the lowered position and portions of the housing and other parts cut away to show interior details.
Figure 2:
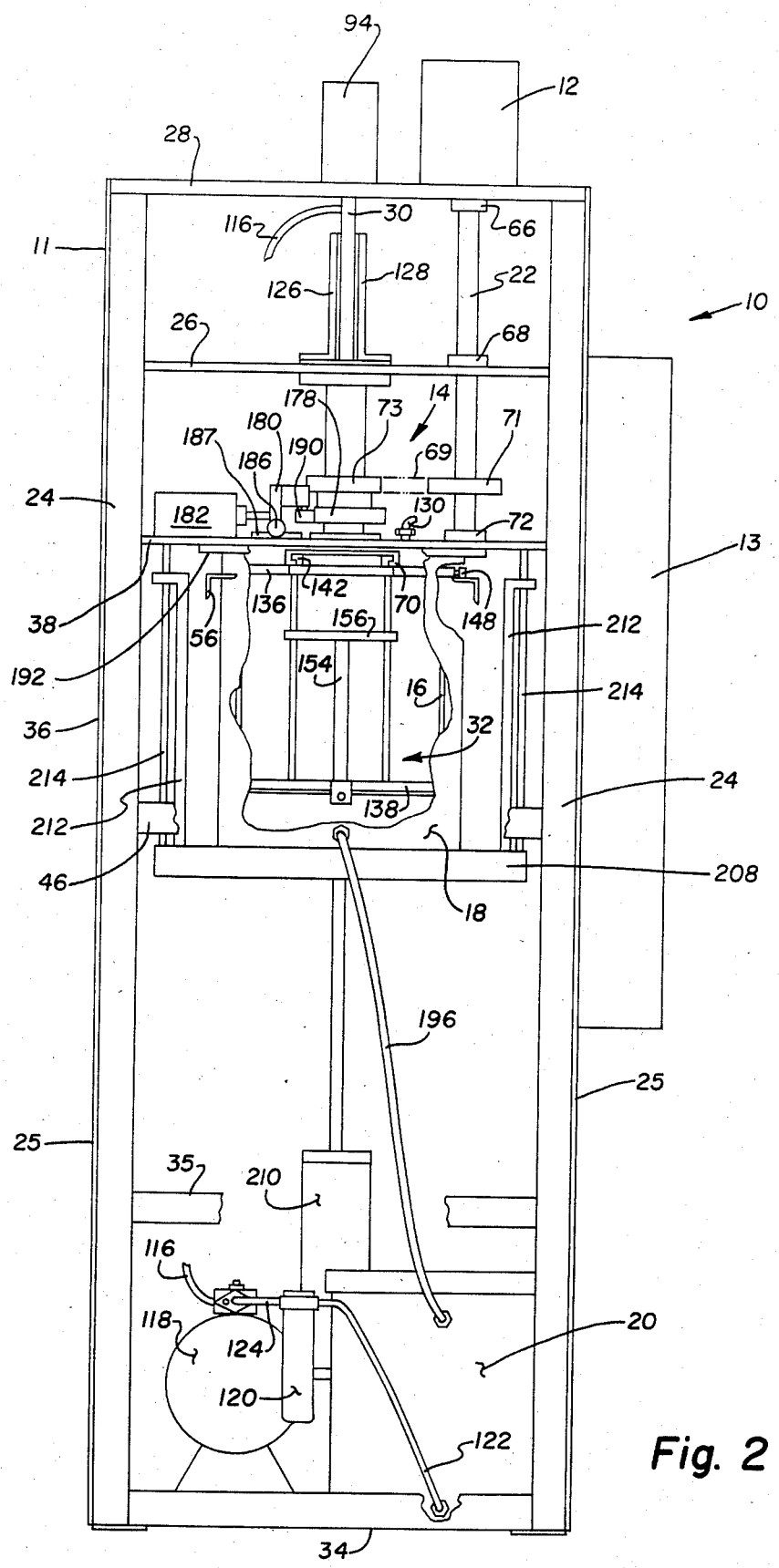
FIG. 2 is a side plan view of the apparatus of the invention with the coating chamber in the raised position and portions of the housing and other parts cut away to show interior details.

Referring to FIGS. 1 and 2, the parts coating apparatus 10 of the invention is shown. A housing 11 supports motor 12, which has a shaft 22. The shaft 22, drives a head 15. A basket 16 containing the parts to be coated is detachably coupled to the head 15. The basket 16 is enclosed within a coating compartment 32, which may be separated from the basket by vertical movement of a coating tank 18. Disposed within the head assembly 15 is a spray tube 30 located to spray the parts in the basket 16 enclosed in the coating compartment 32. The parts are sprayed with coating material supplied by a coating material system which includes a reservoir 20 of coating material connected to the spray tube 30. The basket 16 of coated parts is removed from the head 15 by a shuttle assembly 40 and a second basket 16 is placed on the head 15 by a second shuttle assembly 40.

The motor 12 moves the head assembly 15 and the basket 16 during all or part of the time the parts are being sprayed. The motor 12 is an air motor actuated by compressed air supplied by a fluid control circuit 17 shown in FIGS. 7 and 8. The air motor 12 is rapidly reversible, i.e., rapidly changes direction of rotation and rapidly accelerates back up to speed. The parts are agitated by first rotating the motor 12 in one direction then in the opposite direction. When the direction of rotation of head 15 and the basket 16 is charged, the parts are tumbled. This ensures that the various surfaces of the parts are exposed to the sprayed coating material and that the parts do not adhere to each other or the basket 16 while they are being sprayed. After spraying, the motor 12 spins the head 15 and basket 16 to centrifugally remove excess coating material from the parts. The excess coating is collected in a coating tank 18 for return to the reservoir 20. The movements of the head 15 and the spraying of the coating material are controlled by a control system consisting of fluid control circuit 17 shown in FIGS. 7 and 8 which actuates the motor 12 and the coating material system and an electrical control circuit which operating through the fluid control circuit 17 and in accordance with the user's selections, controls the sequence, duration, and timing of the actuation of the movements of the motor 12 and the spraying of the coating material.

The housing 11 in a preferred embodiment of the invention 10, includes a main portion 36, and two shuttle portions 48. In addition the housing 11 includes two side portions 42 to stabilize the housing 11 against overturning. The main frame 36 consists of vertical corner supports 24 joined to horizontal members 26, 28, 34, 35, 38, 46 covered by outer panels 25. The side frames consist of side horizontal members 50, side vertical members 52 and outer panels 54. The shuttle frames 48 consist of shuttle frame horizontal members 58, vertical members 60, and braces 62. The shuttle frames bear support rails 56 which extend into the main portion 36 of the housing 11. The main portion 36 of the housing 11 is provided with access openings 44 to allow for movement of the baskets 16 on the support rails 56. In a specific embodiment of the invention, doors, operated by means of the fluid control circuit 17, could be provided to cover the access openings 44. In the embodiment described herein, the control system includes, attached to the housing 11, a control panel 13 containing the electrical control circuit.

In a specific embodiment of the invention 10, the housing 11 does not include side portions 42 and shuttle frames 48. In that embodiment, a single basket 16 is movable along support rails 56 which are mounted to and extend out from the housing 11.

The motor 12 is mounted to horizontal member 28 and drives a shaft 22 which turns within guides 66, 68, 72 mounted to the horizontal members 28, 26, 38, respectively. The shaft 22 engages a positive drive mechanism 14, which drives the head assembly 15. The positive drive mechanism 14 may be a timing belt and sprockets or a drive chain and sprockets or a gear train or an equivalent mechanism for driving the head 15 without slippage. FIG. 2 shows a drive chain 69 and sprockets 71, 73.

Figure 3:
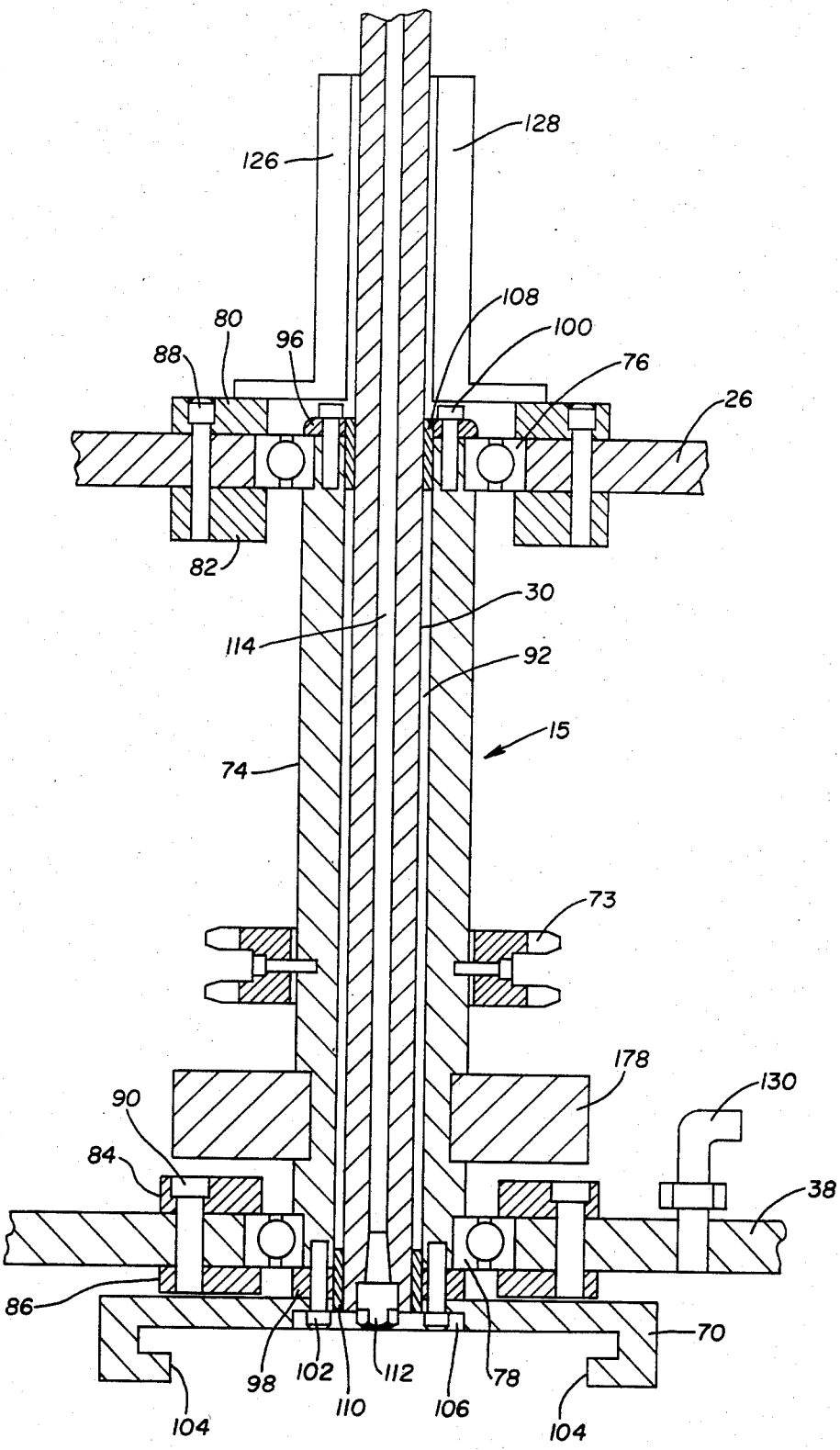
FIG. 3 is a vertical cross sectional view of the head as mounted in the apparatus of the invention.
Figure 6:
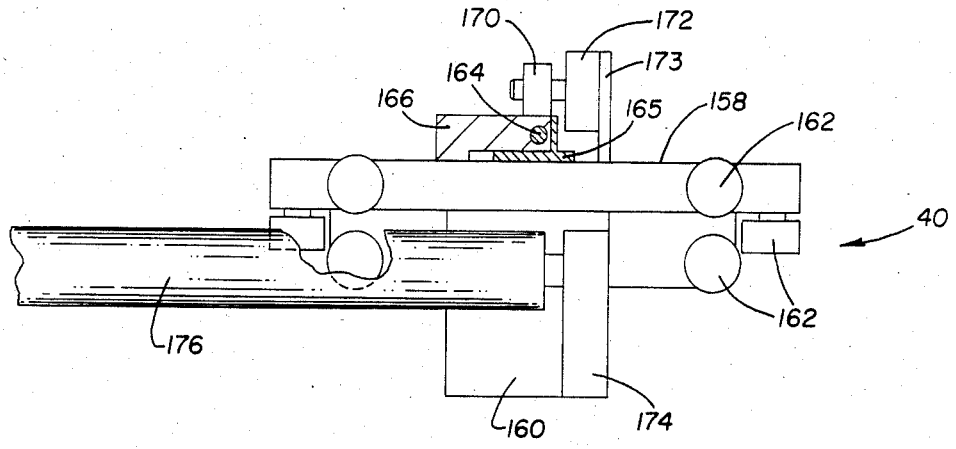
FIG. 6 is a side plan view of the shuttle assembly taken substantially along line 6—6 of FIG. 4, and FIGS. 7 and 8 are a schematic diagram of the fluid control circuit employed in the apparatus of the invention.

Referring to FIG. 3, the head 15 is shown to be rotatably mounted to the horizontal members 26, 38 of the housing 11 by bearings 76, 78 respectively. The bearings 76, 78 are mounted to their respective horizontal members 26, 38 by bearing retainers 80, 82 and 84, 86 and bolts 88, 90, all respectively or their equivalents.

The head assembly 15 has a sleeve 74 to which the bearings 76, 78 are mounted by bearing retainers 96 and 98 and bolts 100, 102, all respectively or their equivalents. A central passage 92 extends through the sleeve 74.

The head assembly 15 has a basket mounting 70 attached to the sleeve 74 by bolts 102 or their equivalents. The basket mounting 70 has a pair of parallel flanges 104 which extend inward below the basket mounting 70. The basket mounting 70 has a central opening 106 alligned with the central passage 92 of the sleeve 74.

Mounted in the central passage 92 of the sleeve 74 are annular sleeve spacers 108, 110. The sleeve spacers 108, 110 may be bushings or bearings or their equivalents.

Disposed within the central passage 92 of the sleeve 74 of the head assembly 15 is the spray tube 30. The spray tube 30 is joined to an air cylinder 94 supported by the horizontal member 28. The spray tube 30 is slidably mounted in the central passage 92. The spray tube 30 is movable between a retracted position and an extended position by actuation of the air cylinder 94 by pressurized air provided by the fluid control circuit 17, shown in FIGS. 7 and 8. Guide members 126, 128 support the movement of the spray tube 30. A nozzle 112 is attached to the spray tube 30. The characteristics of the nozzle 112 are determined by the coating material used. It is generally desirable, however, to use a nozzle 112 which has a generally downward and circularly directed spray pattern. It is convenient to have engagable male and female threads or the equivalent on the nozzle 112 and spray tube 30 to permit interchange of different nozzles 112 and replacement of worn nozzles 112.

The nozzle 112 communicates with a longitudinal bore 114 in the spray tube 30. The bore 114 communicates with a supply hose 116 connected to a pump 118 which supplies coating material from the reservoir 20 through a filter 120 and hoses 122, 124. In a specific embodiment of the invention the pump 118 could be replaced by instead using pressurized air from the fluid control circuit 17.

Figure 4:
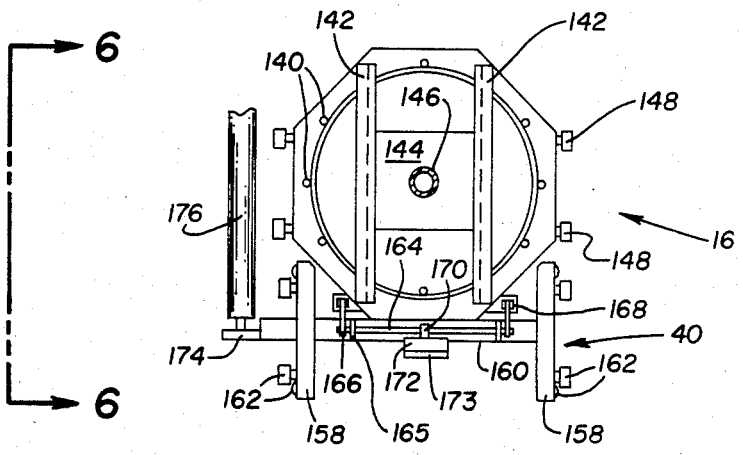
FIG. 4 is a top plan view of the basket and shuttle assembly of the apparatus of the invention.
Figure 5:
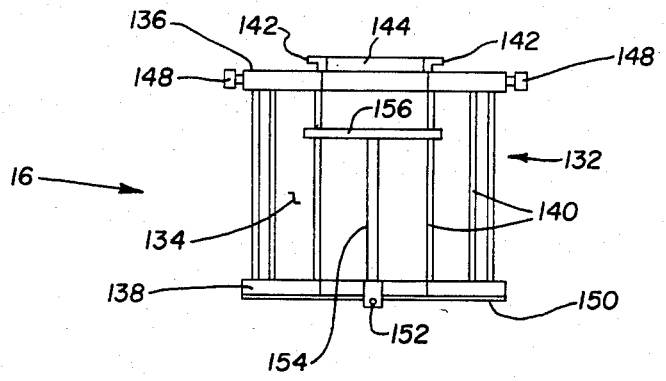
FIG. 5 is a side plan view of the basket shown in FIG. 4.

The basket 16 has an upper basket assembly having a frame 132 and panels 134 which are formed of perforated sheet or screening or the equivalent. The basket is thus generally perforate to the coating material. The frame 132 has upper and lower frame members 136, 138 held in spaced relationship by a series of pins 140, as shown in FIGS. 4 and 5. Mounted to upper frame member 136 are parallel basket rails 142 which project outward to couple with the flanges 104 of the basket mounting 70. The basket rails 142 have disposed between them an upper plate 144 which bears a central collar 146. The collar 146 is a brass bushing or the like and is sized and positioned to engage the spray tube 30 when the spray tube 30 is in the extended position. In a preferred embodiment of the invention 10, the spray tube 30 is in the extended position whenever the head 15 and basket 16 are rotated. In that embodiment, the spray tube 30, acts as an axle upon which the basket 16 can rotate and the spray tube limits radial movement of the basket 16 to restrain the basket 16 as it rotates. Projecting outward from the upper frame member 136 are rotatably mounted rollers 148 which support the basket 16 during movement of the basket 16 on the support rails 56.

The bottom of basket 16 is closed by a base plate 150 which has a transverse central axle 152, which is pivotably mounted to lower frame member 138. A vertical basket handle 154 is attached to the base plate 150 and is retained in position by a catch 156 attached to the frame 132. Movement of the basket handle 154 tilts the base plate 150 discharging parts from the basket 16. In a specific embodiment of the invention, a perforate conical central core is disposed on the base plate 150. The core prevents parts from occupying the center of the basket 16 and thus not being adequately agitated and to direct the tumbling of parts in a radial direction in addition to the tangential tumbling otherwise provided.

In other specific embodiments of the invention, manual or powered material handling means for tipping the basket 16 to discharge parts may be provided instead of the base plate 150.

The baskets 16 are moved into and out of engagement with the basket mounting 70 and along the support rails 56 by shuttle assemblies 40. The duplicate shuttle assemblies 40 and baskets 16 of a preferred embodiment of the invention allow parts in one basket 16 to be coated while parts are loaded into and out of the other basket 16.

The shuttle assemblies 40 each include two carriages 158 joined by a shuttle body 160. The carriages each have rotatably mounted carriage rollers 162 which ride against a support rails 56 when the shuttle assembly 40 is moved. A shuttle axle 164 is mounted to the shuttle body 160 by pivot bushings 165. Attached to the shuttle axle 164 are a pair of fingers 166 which pivot with the shuttle axle 164. The fingers 166 are positioned to be pivotable into and out of engagement with the shuttle slots 168 in a basket 16. A link 170 connects the shuttle axle 164 to an air cylinder 172, which is attached to the shuttle body 160 by a plate 173. The air cylinder 172 pivots the shuttle axle 164 when actuated by the fluid control circuit 17 shown in FIGS. 7 and 8.

A side plate 174 extends from one of the carriages 158. The side plate 174 is connected to an air cylinder 176 which moves the shuttle assembly 40 along the support rails 56 when actuated by the fluid control circuit 17 system shown in FIGS. 7 and 8.

The shuttle assemblies 40 are each displaceable on the support rails 56 by an air cylinder 176 between three positions, inboard, outboard and standby. In the inboard position the shuttle assembly 40 is within the main portion 36 of the housing 11 and a basket 16 engaged by the fingers 166 of the shuttle assembly 40 is held by the basket mounting 70. In the outboard position, the shuttle assembly 40 is in a shuttle portion 48 of the housing 11, and a basket 16 engaged by the shuttle assembly 40 would be supported by the basket rails 56 of a shuttle portion 48 of the housing 11.

A shuttle assembly 40 is displaced to the standby position after moving a basket 16 from a first position in the shuttle portion 48 of the housing 11 to a second position in the main portion 36 of the housing 11 in which the basket rails 142 engage the flanges 104 of the basket mounting 70. The shuttle assembly 40 is then disengaged from the basket 16 by pivoting the fingers 166 and the shuttle assembly 40 is then moved to the standby position to permit the coating tank 18 to be raised. The standby position is at a minimum clearance distance so that after spraying is completed and the coating tank 18 is lowered the shuttle assembly 40 may engage the basket 16 with a minimum delay for travel of the shuttle assembly 40 along the support rails 56.

The shuttle portion 48 of the housing 11 has mounted on it an unloader 177 which has a bifurcated unloader arm 179 attached to an air cylinder 181. The unloader arm 179 is movable from a neutral position to an engaged position, by means of the air cylinder 181 to engage and move the basket handle 154, tilt the base plate 150 and discharge the parts from the basket 16. The air cylinder 181 is actuated by the fluid control circuit 17 shown in FIGS. 7 and 8.

The coating compartment 32 is formed by the tank ring 192 and the coating tank 18 and in addition a portion of the head 15 and a section of the horizontal member 38 enclosed by the tank ring 192. The coating compartment 32 is generally imperforate to the coating material, in order to contain the coating material. The coating compartment 32 additionally functions as armor to protect the user of the apparatus from injury should catastrophic breakdown of the basket 16 occur. In a specific embodiment of the invention, the coating compartment 32 is gas tight to pressurized gas.

The coating tank 18 is mounted on a platform 208 within the housing 11. The platform 208 is vertically movable, to move the coating tank 18 between a lowered position in which the basket is separated from the coating compartment 32 and a raised position in which the coating compartment 32 encloses the basket 16. Movement of platform 208 is provided by means of an air cylinder 210 controlled by the fluid control circuit 17 shown in FIGS. 7 and 8. Guide elements 212 attached to the platform 208, slide along guide rods 214 when the platform 208 is moved.

The coating tank 18 has a drain. Attached to the drain 194 is a drain hose 196 connected to the reservoir 20. The drain hose 196 may be disconnected from the reservoir 20 for disposal of used coating material.

In a specific embodiment of the invention the coating material may be pumped from the drain hose 196 through a filter and a pump back into the reservoir 20.

In a specific embodiment of the invention 10 described herein, a gas inlet 130 extends through horizontal member 38 into the coating compartment 32 so that a selected gas or combination of gases such as for example, the inert gas argon can be forced into the coating compartment 32. The gas inlet 130 is connected to a gas system 198 comprising a gas tank 200, a manual valve 202, a pressure regulator 204 and a slide valve 242 as shown in FIG. 8 to provide for release of the gas into the coating compartment 32. Actuation of the gas system is provided by the fluid control circuit 17 shown in FIGS. 7 and 8.

In a specific embodiment of the invention the supply hose 116 can be selectively switched between the reservoir 20 and a tank of cleaning fluid so that the pump 118 can pump the cleaning fluid through spray tube 30 into the coating compartment 32. In that embodiment, the drain hose 196 is likewise selectively switchable between a disposal tank and the reservoir 20. Switching can be provided by the control system for automatic cleaning on a regular basis when the apparatus 10 is not in use if desired.

Mounted in a fixed position on the head assembly 15 is a cam 178 which cooperates with a cam follower 180 to stop the head 15 in a position in which the flanges 104, the basket rails 142, and rollers 148 are aligned with support rails 56 to facilitate placement and removal of the basket 16. The cam follower 180 is movable into contact with the cam 178 by means of an air cylinder 182. More specifically, air cylinder 182 is mounted to horizontal member 38 and to the cam follower 180 which moves along horizontal member 38 on guide rollers 186 and guide track 187 or equivalent means. The cam 178 has a single lobe 188. The cam follower 180 has spaced cam follower rollers 190 mounted to come into contact with and arrest the cam 178 with the lobe 188 positioned between the cam follower rollers 190.

Figure 7:
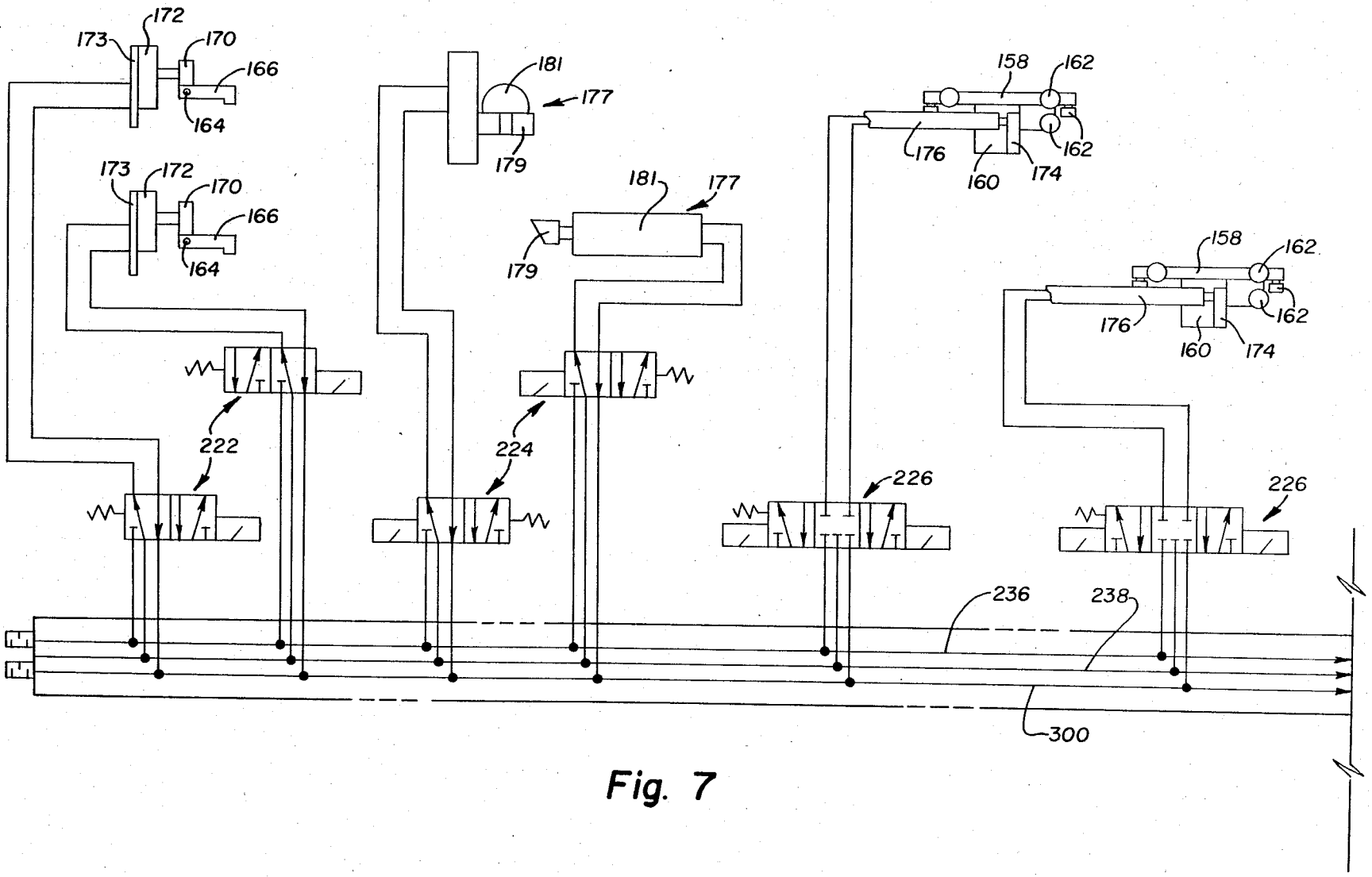
Figure 8:
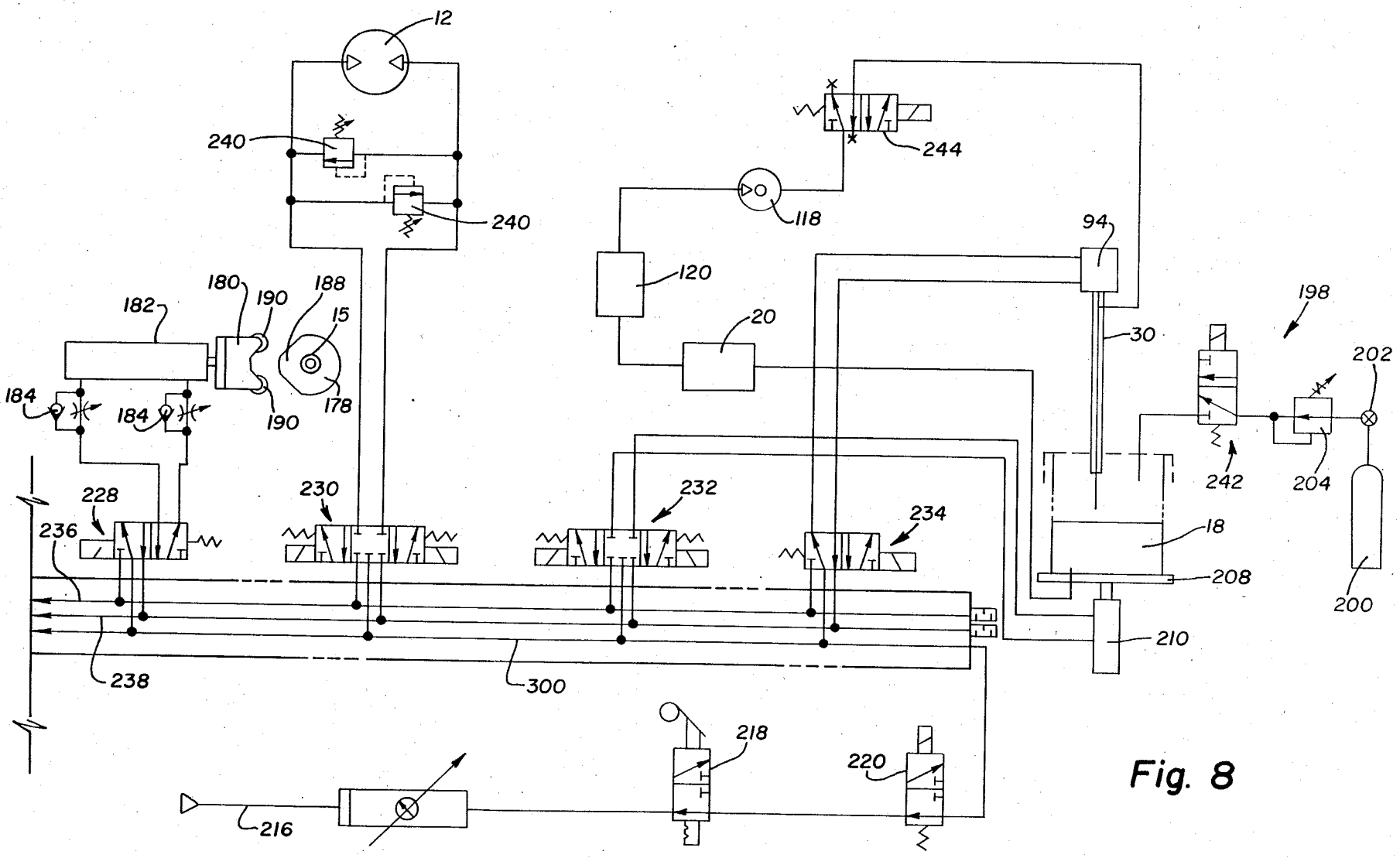

The fluid control circuit 17 is shown in FIGS. 7 and 8. Individual regulators, valving and limit switches are not shown in the figures but would be used in the apparatus 10 of the invention as would be appropriate for particular applications of the apparatus 10. Compressed air is supplied by an input line 216, controlled by manual control valve 218 and relief valve 220. The pressurized air would typically be supplied by a central source or a separate air compressor. Exhaust lines 236, 238 are coupled to the fluid control circuit to permit the venting of air.

Slide valves 222 are two position valves, which control air cylinders 172. Slide valves 224 are two position valves which control air cylinders 181. Slide valves 226 are three position valves which control air cylinders 176.

Slide valve 228 is a two position valve, which controls air cylinder 182.

The air lines leading to air cylinder 182 contain adjustable flow regulators 184 to adjust the amount the "spring effect" that will be exerted by air cylinder 182 in actuating cam follower 180.

Slide valve 230 is a three position valve, which is coupled to the air motor 12. Two postions of valve 230 provide for driving the air motor 12 in forward and reverse directions. A neutral position of valve 230 is provided wherein the air motor 12 is stopped. The speed of the air motor 12 is controlled by electrically actuated flow control valves 240. Slide valve 232 is a three position valve, which controls the air cylinder 210 to raise and lower the coating tank 18. Slide valve 234 is a two position valve, which controls the air cylinder 94 to provide for raising and lowering of the spray tube 30. Slide valve 244 is an electrically actuated two position valve which controls the flow of coating to the spray tube 30. In the embodiment of the invention in which a particular gas or combination of gases is used, the gas system 198 is controlled by an electrically actuated two position slide valve 242.

The actuation of the electrically actuated valves 222, 224, 226, 228, 230, 232, 234, 242, 244 in the fluid control circuit is performed by the electrical control circuit. It is convenient to use a programmed computer for the electrical control circuit. Many different types of computers or process controllers could be employed such as for example a Texas Instruments Model 510 or Modican 84 or General Electric Series 1.

In operation, the parts that are to be coated are loaded into a basket 16 while it is on support rails 56 in a shuttle portion 48 of the housing 11 and the shuttle assembly 40 is in the outboard position. Loading may be done by hand or by a conveyor belt or other automatic means. The parts might typically range from relatively small parts such as nails and bushings to relatively large complex parts such as castings which require coating of interior and exterior surfaces. The basket 16 is displaced along the support rails 56 by the shuttle assembly 40 until the shuttle assembly 40 is in the inboard position and the basket rails 142 engage the flanges 104 of the basket mounting 70 and the basket 16 is centered on the basket mounting 70. The fingers 166 of the shuttle assembly 40 are then pivoted to disengage the shuttle assembly 40 from the basket 16. The shuttle assembly 40 is then moved to the standby position on the support rails 56. The coating tank 18 is then raised to enclose the basket 16 in the coating compartment 32.

In an embodiment of the invention using a particular atmosphere, the gas system is actuated by means of valves 240 and 204 to supply the gas to the coating compartment 32. In a specific embodiment of the invention, while the gas is supplied the coating tank 18 is held below the tank ring 192 so that air is expelled through a gap between the coating tank 18 and the tank ring 192. In another embodiment of the invention a purging system withdraws the air. The spray tube 30 is then extended from its retracted position within the head 15 to the extended position in which the spray tube 30 extends into the basket 16 through the collar 146.

The motor 12, head 15, and basket 16 are then rotated. The air motor 12 spins first one direction and then the other. The length of time the basket 16 rotates before reversing is selected by means of the electrical control circuit, as required by particular applications. The adjustment may be made to less than a full revolution of the basket 16 between reversals of the motor 12.

The pump 118 of the coating material system 31 is actuated when the apparatus 10 of the invention is started and is continally operated during the operation of the apparatus 10. Coating material is thus sprayed by the spray tube 30 by the actuation of valve 244. Like the rotation of the motor 12, the sequence, duration, and timing of spraying is controlled by the electrical control circuit. To coat a basket 16 of parts might for example, take roughly 90 seconds from start to finish with several spraying steps totalling 15 seconds. After the parts have been sprayed the basket 16 is stopped, to allow suspended coating material to settle.

During the spraying, parts are coated by coating material propelled directly at the parts and by a fog of coating material build up in the coating compartment 32 during spraying. The perforate nature of the basket 16 provides for ready circulation of this fog of coating material around the parts.

Although the apparatus 10 of the invention permits the parts to be sprayed while static, generally the parts would be sprayed while in motion relative to the spray tube 30. This provides for greatly different angular velocities of the parts and of droplets of coating material. This results in droplets impacting the parts obliquely, and each droplet painting a larger area with a thinner coating.

After the parts have been sprayed with the coating material the parts are spun to remove excess coating material, which returns to the reservoir 20.

After completion of the spinning, the rotation of the motor 12 is slowed and the cam follower 234 is extended into the path of the rotating cam 230 so as to stop the rotating head 15 and basket 16 in a position in which the basket handle 154 is disposed toward the direction of the shuttle portion 48 of the housing 11 which is not already occupied by the other basket 16. The shuttle assembly 40, adjacent the basket handle 154 of the basket 16, is then moved by its air cylinder 176 from a standby position to an inboard position. The basket 16 is then engaged by the fingers 166 of that shuttle assembly 40 and the shuttle assembly 40 then moves the basket 16 onto the support rails 56 and out of the main portion 36 of the housing 11 and into that shuttle assembly's 40 respective shuttle portion 48 of the housing 11. The unloader arm 179 is then moved into engagement with the basket handle 154 and the basket handle 154 is moved pivoting the base plate 150 of the basket 16 discharging the parts onto tables or a conveyor belt. The movement of the unloader arm 179 can be repeated, if the user so selects, to ensure that all parts have been discharged. The unloader arm 179 then returns to its original position as does the bottom plate 150 of the basket 16. The bottom plate 150 does so because of its weight, or in the alternative a biasing means can be used. The basket 16 may then be again loaded.

The baskets 16 operate alternatively with each other and as one basket 16 is moved out of the main portion of the housing 11 for unloading another is moved in for spraying.

All electrical connections within the apparatus 10 of the invention are explosion-proof, as they are sealed in conduit or are within the control panel 13. However, for use of flammable coating, ventilation ductwork could be added to the apparatus 10 of the invention to protect the user.

Coating materials that may be applied include but are not limited to: acrylics, epoxies, adhesives, lacquers, lubricants, phenolics, Teflon®, varnishes, paints, and other water based and solvent based coatings.

The method of the invention is in its broadest form, in summary, loading parts into a basket generally perforate to the coating material, detachably coupling the basket to a rotatable head, separably enclosing the basket in a coating compartment generally imperforate to the coating material, supplying coating material to a spray tube from a coating material system, spraying said coating material from said spray tube onto said parts while the basket is enclosed in the coating compartment, agitating the parts by rotatably moving the basket and head while the basket is in the coating compartment, separating the basket from the coating compartment and unloading the basket.

The parts are agitated by rotating the basket first in one direction and then in the other. The change in direction of rotation is rapid and the basket rapidly accelerates up to speed again after the direct of rotation is changed. The change in direction and acceleration of rotation tumbles the parts. The basket need not be rotated an entire revolution in each direction before the direction of rotation is changed but need only be oscillated back and forth through partial revolutions if desired.

While the basket is in the coating compartment the parts are sprayed with the coating material. The spraying may alternate or be simultaneous with agitating the parts. For example, the parts may be sprayed as they are tumbled. The parts tumble in directions that are generally tangential to the directions of rotation of the basket. In a specific embodiment the basket includes a core which directs the tumbling of the parts in a radial direction in addition to the tangential one.

After the parts are sprayed and agitated in accordance with a selected sequence, duration, and timing of those operations programmed into the electrical control circuit, excess coating material is removed from the parts, by spinning the basket. The excess coating material is recycled to the coating material system for reuse.

Specific embodiments of the method of the invention include pumping the excess coating material to a reservoir of the coating material system to recycle it and filtering the excess coating material while recycling it.

In one embodiment of the method of the invention the spraying and agitating steps are performed under an atmosphere determined by the requirements of a particular coating material, for example, some coatings require use of a non-oxidizing atmosphere, and argon or helium or another inert gas could be used.

In a specific embodiment of the method the atmosphere the spraying and agitating steps are performed under is pressurized to more or less than atmospheric pressure.

While a specific embodiment of the invention has been shown and described herein for purposes of illustration only, it is desired that the protection afforded by any patent which may issue upon this application not be limited strictly to the disclosed embodiment; but that it extend to all structures and arrangements which contain the essence of the invention and which fall fairly within the scope of the claims which are appended hereto.

What is claimed is:

1. A parts coating apparatus comprising: a housing, a motor supported by said housing, a head driven by said motor, said head being rotatably mounted to said housing, at least one basket to contain parts to be coated, said basket being perforate to the coating material to be applied to said parts, each said basket being detachably coupleable to and rotatable with said head, a coating compartment, said coating compartment being capable of separably enclosing said basket when said basket is coupled to said head, said coating compartment being generally imperforate to said coating material, a spray tube communicating with said coating compartment to spray parts within said coating compartment with said coating material, said spray tube restraining said basket from radial movement of said basket during rotational movement thereof, a coating material supply system providing said coating material to said spray tube, a control system selectively actuating said motor and said coating material supply system.

2. The apparatus of claim 1 further comprising, a positive drive driving said head, said positive drive being driven by said motor.

3. The apparatus of claim 1 wherein said spray tube extends through said head into said coating compartment.

4. The apparatus of claim 1 wherein said spray tube is extendable into said basket.

5. The apparatus of claim 1 wherein said motor is rapidly reversible to tumble said parts.

6. The apparatus of claim 1 wherein said coating material system further comprises, a reservoir, a pump, a filter and a plurality of hoses, said hoses interconnecting said reservoir, said pump, said filter, said spray tube, and said coating compartment, to supply, by the action of said pump, said coating material to said spray tube from said reservoir and to return excess said coating material from said coating compartment to said reservoir through said filter.

7. The apparatus of claim 1 further comprising a gas supply system connected to said coating compartment.

8. The apparatus of claim 7 wherein said coating compartment is imperforate to pressurized gas.

9. The apparatus of claim 1 wherein said coating compartment further comprises a tank ring mounted to said housing, and a coating tank, said coating tank being displaceable between a raised position wherein said basket is enclosed and a lowered position wherein said basket is separated from said coating compartment.

10. The apparatus of claim 1 wherein said basket has basket rails and said head has a basket mounting having flanges, said basket rails detachably engaging said flanges to detachably couple said basket to said head.

11. The parts coating apparatus of claim 1 wherein said housing further comprises a main portion and at least one shuttle portion and wherein each said basket is displaceable from a first position within a shuttle portion of said housing to a second position within said main portion of said housing, each said basket in said second position being detachably coupled to said head.

12. The apparatus of claim 1 further comprising a cam rotated by said motor, the rotation of said cam being of a fixed relationship to the rotation of said head, and a cam follower, said cam follower being displaceable into contact with said cam to stop said head in a position wherein said basket is detachable from said head.

13. The apparatus of claim 1 further comprising a cleaning fluid system selectively supplying cleaning fluid to said spray tube.

14. The apparatus of claim 1 wherein said control system further comprises a fluid control circuit and an electrical control circuit, said fluid control circuit actuating said motor and said coating material system, said electrical control circuit controlling the sequence, duration, and timing of said actuation.

15. The apparatus of claim 14 wherein said electrical control circuit is a programmed computer.

16. The apparatus of claim 14 wherein said motor is an air motor.

17. A parts coating apparatus, for applying coating material to parts, said apparatus comprising: a housing, said housing having a main portion and two shuttle portions, a motor supported by said housing to agitate said parts, said motor being rapidly reversible, a positive drive, said positive drive being driven by said motor, a head driven by said positive drive, said head being rotatably mounted to said housing, a pair of baskets, to contain said parts, said baskets each being detachably coupleable to said head, said baskets each being perforate to said coating material, said baskets each being alternately displaceable from a first position within a respective one of said shuttle portions of said housing to a second position within said main portion of said housing, each said basket in said second position being detachably coupled to said head, a coating compartment, said coating compartment separably enclosing said baskets alternately, said coating compartment being generally imperforate to said coating material, a spray tube, communicating with said coating compartment, to spray parts with said coating material, a coating material system supplying said coating material to said spray tube, a control system system selectively actuating said motor and said coating material system.

18. The apparatus of claim 17 further comprising a pair of shuttle assemblies, said shuttle assemblies being displaceable between an outboard position and an inboard position, said shuttle assemblies detachably engaging said baskets, on a one to one basis to move said baskets between said first position and said second position.

19. The apparatus of claim 17 wherein said basket has an upper basket assembly, a base plate, and a basket handle, said base plate being attached to said basket handle, said base plate being pivotable in relation to said upper basket assembly by movement of said basket handle to discharge said parts.

20. The apparatus of claim 19 further comprising a pair of unloader arms, said unloader arms each being movable from a neutral position to an engaged position, said unloader arms being disposed on said shuttle portions of said housing on a one to one basis, to pivot said basket handles of said baskets when said baskets are in said first position, upon movement of said unloader arms from said neutral position to said engaged position.

21. The apparatus of claim 11 further comprising at least one shuttle assembly, each said shuttle assembly being displaceable between an outboard position and an inboard position, each said shuttle assembly being capable of detachably engaging each said basket, on a one-to-one basis to move each said basket between said first position and said second position.

22. The apparatus of claim 11 wherein each said basket has an upper basket assembly, a base plate, and a basket handle, said base plate being attached to said basket handle, said base plate being pivotable in relation to said upper basket assembly by movement of said basket handle to discharge said parts.

23. The apparatus of claim 22 further comprising at least one unloader arm, each said unloader arm being movable from a neutral position to an engaged position, each said unloader arm being disposed on a respective said shuttle portion of said housing on a one-to-one basis, to pivot said basket handle of each said basket when each said basket is in said first position, upon movement from said neutral position to said engaged position.

24. The apparatus of claim 11 further comprising, a positive drive driving said head, said positive drive being driven by said motor.

25. The apparatus of claim 11 wherein said spray tube extends through said head to said coating compartment.

26. The apparatus of claim 11 wherein said spray tube is extendable into said basket.

27. The apparatus of claim 11 wherein said motor is rapidly reversible to tumble said parts.

28. The apparatus of claim 11 wherein said coating material system further comprises, a reservoir, a pump, a filter and a plurality of hoses, said hoses interconnecting said reservoir, said pump, said filter, said spray tube, and said coating compartment, to supply, by the action of said pump, said coating material to said spray tube from said reservoir and to return excess said coating material from said coating compartment to said reservoir through said filter.

29. The apparatus of claim 11 further comprising a gas supply system connected to said coating compartment.

30. The apparatus of claim 11 wherein said coating compartment is imperforate to pressurized gas.

31. The apparatus of claim 11 wherein said coating compartment further comprises a tank ring mounted to said housing, and a coating tank, said coating tank being displaceable between a raised position wherein said basket is enclosed and a lowered position wherein said basket is separated from said coating compartment.

32. The apparatus of claim 11 wherein said basket has basket rails and said head has a basket mounting having flanges, said basket rails detachably engaging said flanges to detachably couple said basket to said head.

33. The apparatus of claim 11 further comprising a cam rotated by said motor, the rotation of said cam being of a fixed relationship to the rotation of said head, and a cam follower, said cam follower being displaceable into contact with said cam to stop said head in a position wherein said basket is detachable from said head.

34. The apparatus of claim 11 further comprising a cleaning fluid system selectively supplying cleaning fluid to said spray tube.

35. The apparatus of claim 11 wherein said control system further comprises a fluid control circuit and an electrical control circuit, said fluid control circuit actuating said motor and said coating material system, said electrical control circuit controlling the sequence, duration, and timing of said actuation.

36. The apparatus of claim 35 wherein said electrical control circuit is a programmed computer.

37. The apparatus of claim 11 wherein said motor is an air motor.

* * * * *